United States Patent [19]

Birkmann

[11] Patent Number: 4,953,243

[45] Date of Patent: Sep. 4, 1990

[54] ELECTRONIC CONTROL WITH EMERGENCY CPR FEATURE FOR ADJUSTABLE BED

[75] Inventor: Kenneth R. Birkmann, St. Peters, Mo.

[73] Assignee: Amedco Health Care, Inc., Wright City, Mo.

[21] Appl. No.: 391,886

[22] Filed: Aug. 9, 1989

[51] Int. Cl.[5] ..... A61G 7/06

[52] U.S. Cl. ..... 5/60; 5/66

[58] Field of Search ..... 5/60, 62–69

[56] References Cited

U.S. PATENT DOCUMENTS

| | | | |
|---|---|---|---|
| 3,913,153 | 10/1975 | Adams et al. | 5/66 |
| 4,044,286 | 8/1977 | Adams et al. | 5/66 |
| 4,159,496 | 6/1979 | Stevens | 5/68 X |
| 4,435,862 | 3/1984 | King et al. | 5/66 |
| 4,472,845 | 9/1984 | Chivetta et al. | 5/66 X |
| 4,751,754 | 6/1988 | Bailey et al. | 5/68 |

*Primary Examiner*—Michael F. Trettel

*Attorney, Agent, or Firm*—Rogers, Howell & Haferkamp

[57] ABSTRACT

An emergency CPR feature is comprised of a timer and logic circuit mounted to a PC card with connections that are compatible to many existing control circuits for an adjustable hospital bed. The emergency CPR feature provides for "hands free" automatically repositioning of an adjustable hospital bed at a desired height, e.g., the full up position, with a flat mattress upon entry of a coded command by simultaneously depressing two switches, e.g., a foot and hand switch, by a trained attendant. The circuitry is contained on a single PC card which may be readily retrofit into existing adjustable hospital beds as well as incorporated into newly manufactured beds.

13 Claims, 3 Drawing Sheets

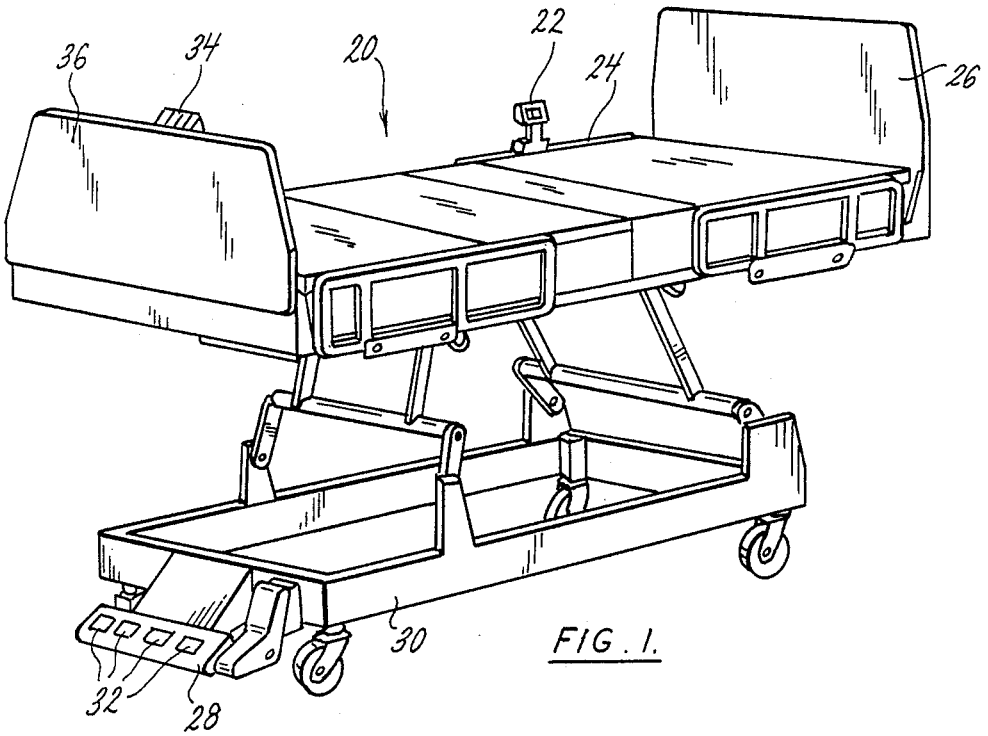
FIG. 1.
FIG. 3.
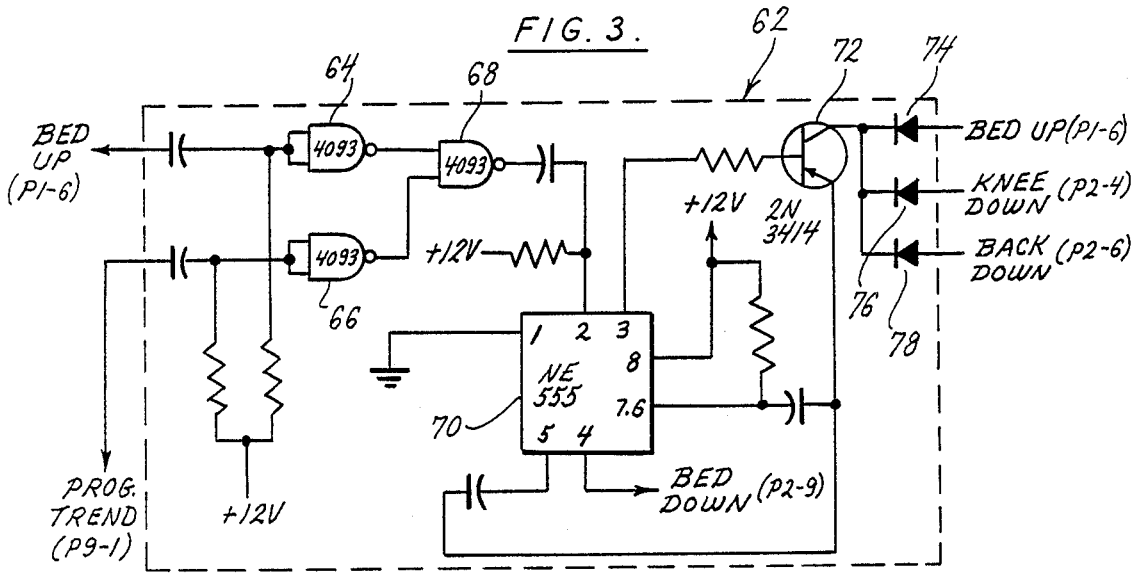

ELECTRONIC CONTROL WITH EMERGENCY CPR FEATURE FOR ADJUSTABLE BED

BACKGROUND AND SUMMARY OF THE INVENTION

Adjustable beds for hospitals have been made for some time and are well known in the art. Most of the present day adjustable beds provide some form of electronic control to adjust the various portions of the bed. Typically, a bed will have an up and down adjustment at the knee of the bed, at the head of the bed, and also for the entire bed frame. These different motors and drives, i.e. head, knee, and bed, are controlled by a wide variety of switch arrangments in the prior art. Some of these include simple manual controls for head up and down, etc. to what is known in the art as a Trendelenburg or reverse Trendelenburg which provides coordinated movement from more than one drive by pressing a single button on a control in order to move the bed into a flat, incline orientation with either the foot or the head elevated from the rest of the bed. Of course, all of these switches are well identified in the prior art to provide immediate information to both the patient and nurse which facilitates controlled movement of the bed into the desired position.

It is also well known in the art that switches to control movement of the various parts of the bed may be actuated either by hand or by foot. For those switches actuated by foot, it can be assumed that some selected patients would not have access to the foot controls, or at least are not readily accessible to a patient such that there is some discrimination in the prior art between those bed functions under patient control and those which are reserved for nurses' control. This is primarily for reasons of safety and to also minimize the tendency for a patient's curiosity with the controls to cause either damage to the bed or potential discomfort or even injury to the patient.

Because of the great concern for the safety of the patient, almost all of the beds in the prior art are provided with drives which move the bed relatively slowly to avoid sudden, rapid repositioning of the patient's body, or a jerky movement, either of which might potentially cause discomfort or even pain to the patient. While these features of the typical prior art bed are intended to provide for the increased comfort and safety of the patient, they are not the most desirable in all situations. For example, in an emergency situation, it would be most desirable to be able to quickly and easily, as well as automatically with hands free commands, reposition the bed from its existing position into an emergency position to facilitate the administering of CPR or other resuscitation efforts. At the same time, it is desirable to utilize a coded command which is not readily ascertainable from the markings on the switches and controls provided to the patient and, perhaps, to some of the staff.

To solve these and other problems in the prior art, and to also improve the functionality of an adjustable bed for emergency situations, the inventors herein have succeeded in designing and developing a control circuit which is operable by existing switches for providing an emergency re-positioning of the adjustable bed from its existing position into a CPR position which is characterized by a flat mattress surface at a specific height, e.g., the full up bed position. Furthermore, in order to provide greater safety and eliminate accidental or inadvertent commands, the inventors have chosen to require virtually simultaneous operation of a switch adapted for foot operation in combination with a switch adapted for hand operation. This renders it virtually impossible for a bed-ridden patient to enter the command, while at the same time requiring a staff member to thoughtfully and consciously utilize both his hand and foot in entering the command. Alternatively, any two switches could be used such as, for example, a pair of hand switches.

This control circuit is comprised of a logic circuit with an electronic timer at its heart along with several logic gates for decoding the coded command signal, and latching on the motors and drives for the various portions of the bed in their appropriate directions in order to automatically achieve the repositioning of the bed in its CPR position. The inventor herein has chosen to utilize the "bed up" foot control along with the "programmed Trendelenburg" or "programmed reverse Trendelenburg" hand switch for the coded command as these controls generally suggest the emergency CPR position in that the bed generally moves up from its existing position and the mattress surface is flat. However, any other combination of controls could be chosen to designate the same function. The timer is set to provide for each motor and its associated drive to travel through the full range of motion. Should the bed be oriented in an intermediate position, the automatic limit switch or mechanical cutouts for the bed drives will stop them in the desired orientation. Thus, the inventors have chosen to utilize a single timer which has a time delay long enough to ensure complete repositioning of the bed to the CPR position from a "worst case" orientation of the bed.

As the emergency CPR control circuit is fully compatible with existing controls and control circuits, and requires no additional mechanical switches or other controls, the inventor has been successful in adapting the entire circuit for mounting on a single PC card which may then be easily retrofitted to existing beds, as well as being easily incorporated into the manufacturing process presently used to manufacture new beds. This additional advantage lends great versatility to the inventor's improvement and provides wider application of the invention to a greater number of beds.

While the principal advantages and features of the present invention have been explained, a more thorough understanding thereof may be obtained by referring to the drawings and brief description of the preferred embodiment which follow.

BRIEF DESCRIPTION OF THE DRAWINGS

FIG. 1 is an isometric view of an adjustable hospital bed in the CPR emergency position;

FIGS. *2a* and *2b* are an e schematic of a typical prior art electronic bed control circuit; and FIG. 3 is an electrical schematic of the emergency CPR circuit of the present invention.

DETAILED DESCRIPTION OF THE PREFERRED EMBODIMENT

Figure 2A:
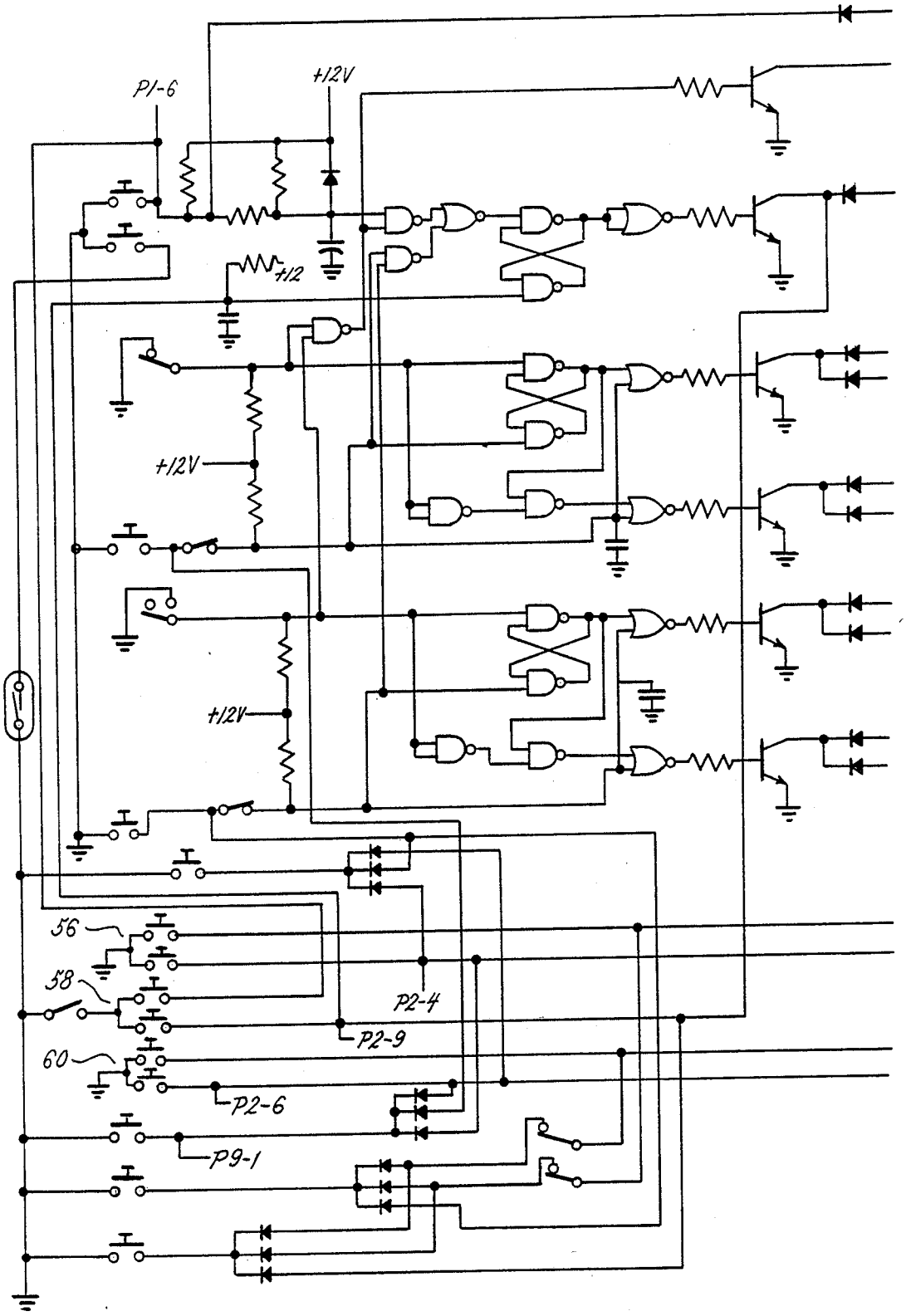
Figure 2B:
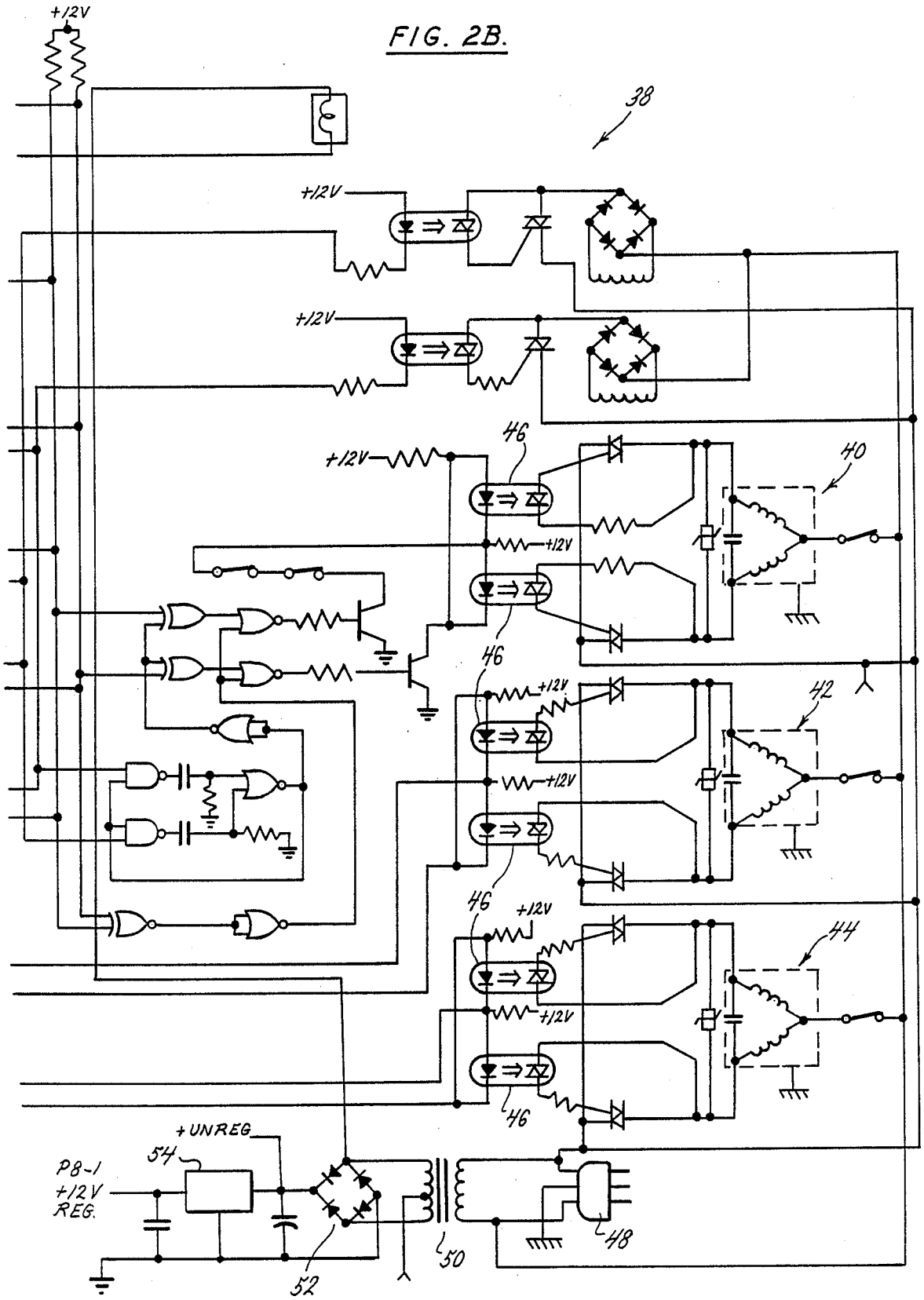

An adjustable hospital bed 20 is shown in FIG. 1 elevated into the emergency CPR position which is characterized by a flat mattress in a full-up position. A hand control 22 is shown on a side rail 24 near the headboard 26 and head end of the bed 20. Additionally, a foot control panel 28 is shown at the foot of the bed on the frame 30 and has several foot actuated switches 32, all as well known in the art. A second hand control 34 is shown mounted on the foot board 36, the controls included in 34 typically being reserved for the nurse, while those in hand control 22 being those generally provided to the patient. For purposes of clarity, the drive motors and drives are not shown in FIG. 1, although their construction is well known in the art.

As shown in FIGS. *2a* and *2b*, an electrical control schematic 38 controls the operation of the motors and drives from the hand and foot controls 22, 28, 34. While the circuitry of FIGS. *2a* and *2b* is well known in the prior art, it will be explained briefly for purposes of understanding the present invention. It includes a bed motor 40, a knee motor 42, and back motor 44 for driving the various bed portions as identified in FIG. 1 to separate positions to thereby achieve the different orientations commonly associated with an adjustable hospital bed 20. The motors 40–44 and their switching is isolated from the low voltage control circuit by six optocouplers 46 so that the bed may be operated with a low voltage control circuit.

An AC plug 48 provides power to the circuit and a low voltage transformer 50, along with its associated fullwave bridge 52 and voltage regulator 54, provide a nominal 12 volts DC for the control circuit. A number of logic gates form the heart of the circuit and are positioned electrically between the hand and foot controls 22, 28, 34 and the motors and their associated switching 42–46. Typically, the patient's hand control 22 is comprised of controls to adjust the position of the knee, bed and back through switch pairs 56, 58, 60, as is known in the art. Other switches, unnumbered, are provided to perform the various other desired functions of the bed and may be located either in the nurse's hand control 34 or the nurse's foot control 28, as desired. These controls would include programmed Trendelenburg, programmed Contour (to move the bed into a preselected contour position), programmed reverse Trendelenburg, etc. Thus, with the electronic schematic of FIGS. *2a* and *2b*, various portions of the adjustable bed may be moved as desired, both by the patient, and by the nurse in order to reposition the bed for the patient's safety and comfort.

As shown in FIG. 3, an emergency CPR PC card 62 includes a series of logic gates and timer to provide a programmed emergency CPR function for the adjustable hospital bed 20. As the "bed up" and "programmed Trendelenburg" switches are actuated, logic gates 64, 66 are actuated which actuates logic gate 68 to turn timer 70 on. Timer 70, when switched on, switches on transistor 72 which is connected through diodes 74, 76, 78 to the bed up, knee down, and back down controls to cause the motors and associated drives to reposition the bed in its full up position with the knee portion down and bed portion down to achieve a flat mattress. As the typical bed and control circuitry (as shown in FIGS. *2a* and *2b*) includes mechanical limit switches to interrupt the circuit when any of the drives position its associated bed portion at the length of its travel, any bed portion can be in any particular position at the time that the emergency CPR feature is actuated and the timer 70 is set to achieve a maximum travel for that drive requiring the most time to reposition its associated bed portion into the desired position. For those of the three which arrive at their desired position early, the mechanical limit switches, or the like, turn off the electronic control and associated motor to prevent damage to the bed and drive. As a safety precaution, the timer 70 may be immediately reset by depressing the "bed down" switch connected to pin 4 of timer 70 which stops the bed at that point in its travel. This provides an immediate safety override should there be any bed malfunction or should the attending personnel desire to interrupt the automatic repositioning of the bed.

While the PC card and associated circuitry of FIG. 3 could be readily provided as part of a control circuit, such as that shown in FIGS. *2a* and *b*, the PC card and associated circuitry of FIG. 3 comprising the present invention is also readily adaptable to existing control circuits and may be easily retrofit into existing adjustable beds to provide this emergency CPR feature. As explained above, the emergency CPR feature provides the automatic repositioning of the bed with "hands free" control such that in emergency situations an attendant can direct their efforts to the patient as the bed automatically brings the patient to the desired position to accommodate those emergency efforts.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. In an adjustable bed having means for repositioning a plurality of portions of said bed with respect to each other, the improvement comprising a control having means for permitting an operator to input a coded command to initiate the automatic repositioning of said plurality of portions so as to bring said bed into a predetermined position on an emergency basis, said control means having a logic means responsive to the coded operator command in order to prevent inadvertent operation.

2. The control of claim 1 wherein said control means further comprises means for permitting hands free operation after entry of said coded operator command.

3. The control of claim 2 wherein said hands free means includes a timer, said timer comprising part of the logic means.

4. The control of claim 3 wherein said control includes a plurality of momentary contact switches connected to the logic means, said coded operator command comprising operation of said momentary contact switches in a pre-determined sequence.

5. The control of claim 4 wherein said logic means is responsive to substantially simultaneous operation of two of said momentary contact switches.

6. The control of claim 5 wherein one of said two switches is adapted for foot actuation and the other of said two switches is adapted for hand operation.

7. The control of claim 3 further comprising means to reset the timer and thereby interrupt the automatic re-positioning of said bed.

8. The control of claim 1 wherein said bed has a knee adjustable portion, a back adjustable portion, and an adjustable height, said pre-determined position comprising knee down and back down thereby forming a flat bed, and height up.

9. The control of claim 8 wherein the logic means includes a timer, said timer having means for activating said knee, back, and height adjustments, and said timer being set for an interval sufficiently long to re-position said bed at the limits of travel of said knee, back, and height adjustments.

10. An electronic circuit for retrofit into the control circuit of an existing adjustable bed, said adjustable bed having means for re-positioning a plurality of portions of said bed with respect to each other, said electronic circuit comprising a PC board, and a logic means mounted on said PC board for de-coding operator entry of a coded command to initiate the automatic re-positioning of said plurality of portions so as to bring said bed into a pre-determined position on an emergency basis, said PC board being adapted for connection to said existing control circuit.

11. The electronic circuit of claim 10 wherein said logic means includes a timer for re-positioning various bed portions for a pre-determined time period.

12. The electronic circuit of claim 11 further comprising means to reset the timer and thereby interrupt the automatic re-positioning of said bed.

13. The electronic circuit of claim 12 wherein the adjustable bed has means for limiting the travel of said various bed portions, said timer being set for a sufficiently long time period to assure the complete re-positioning of the desired bed portions into the desired orientation without operator intervention beyond initial entry of said coded command.

* * * * *